US005320410A

United States Patent [19]

Faiks et al.

[11] Patent Number: 5,320,410

[45] Date of Patent: Jun. 14, 1994

[54] CHAIR CONTROL

[75] Inventors: Frederick S. Faiks, Greenville; Thomas G. Feldpausch, Hastings; Carl V. Forslund, III, Grand Rapids, all of Mich.

[73] Assignee: Steelcase Inc., Grand Rapids, Mich.

[21] Appl. No.: 820,524

[22] Filed: Jan. 14, 1992

[51] Int. Cl.[5] ..... A47C 3/00

[52] U.S. Cl. ..... 297/296; 297/285; 297/300

[58] Field of Search ..... 297/296, 297, 300, 304, 297/306, 285; 267/158, 160

[56] References Cited

U.S. PATENT DOCUMENTS

| | | | |
|---|---|---|---|
| D. 144,719 | 5/1946 | King et al. | 297/288 |
| D. 167,607 | 9/1952 | Becker | D15/11 |
| 530,880 | 12/1894 | Briggs, Jr. | 297/330 X |
| 964,012 | 7/1910 | Folts | 297/302 |
| 1,663,898 | 3/1928 | Bitzenburger . | |
| 2,195,241 | 3/1940 | Cramer et al. | 297/304 |
| 2,264,143 | 11/1941 | Scott et al. . | |
| 2,597,105 | 5/1952 | Julian . | |
| 2,616,484 | 11/1952 | Christie | 297/306 |
| 2,745,468 | 5/1956 | Kramer | 297/285 |
| 3,589,772 | 6/1971 | Leaver | 297/445 |
| 3,743,352 | 7/1973 | Kallander | 297/264 |
| 3,874,727 | 4/1975 | Mehbert et al. | 297/320 |
| 3,917,341 | 11/1975 | Albinson | 297/345 |
| 4,131,315 | 12/1978 | Vogtherr | 297/286 |
| 4,451,085 | 5/1984 | Franck et al. | 297/285 |
| 4,502,729 | 3/1985 | Locher | 297/301 |
| 4,522,444 | 6/1985 | Pollock | 297/239 |
| 4,585,272 | 4/1986 | Ballarini | 297/296 X |
| 4,720,142 | 1/1988 | Holdredge et al. | 297/300 |
| 4,790,596 | 12/1988 | Shifferaw | 297/287 |
| 4,840,426 | 6/1989 | Vogtherr et al. | 297/300 |
| 4,865,384 | 9/1989 | Desanta | 297/304 |
| 4,869,552 | 9/1989 | Tolleson et al. | 297/306 X |
| 4,889,385 | 12/1989 | Chadwick et al. | 297/302 |
| 4,911,501 | 3/1990 | Decker et al. | 297/300 |
| 5,024,484 | 6/1991 | Buchacz | 297/300 |
| 5,046,780 | 9/1991 | Decker et al. | 297/302 |

*Primary Examiner*—Kenneth J. Dorner
*Assistant Examiner*—Milton Nelson, Jr.
*Attorney, Agent, or Firm*—Price, Heneveld, Cooper, DeWitt & Litton

[57] ABSTRACT

A chair control includes a flexible truss having tandem springs interconnected in spaced relation so that they interact to provide a unique torque versus displacement profile during flexing, with a portion of one of the springs moving longitudinally relative to a portion of the other spring as they are flexed. A stop on the springs limits the longitudinal movement, thereby limiting the angle of tilt both in the upright and rearward chair back positions. In one form, the springs are pairs of leaf springs connected in tandem and operably attached to a chair back and bottom formed by a corrugated member. In another form, one of the springs is a flexible shell forming a chair with the other spring attached thereto in a nested arrangement. In yet another form, the flexible truss is a separate module installable in furniture as a self-contained energy absorber.

29 Claims, 4 Drawing Sheets

CHAIR CONTROL

BACKGROUND OF THE INVENTION

The present invention pertains to furniture, and in particular to chairs and the like which provide a unique load versus displacement profile useful for controlling the rearward tilting movement of a movable member such as a chair back.

Chair backs that tilt are commonly used to increase user comfort, such as by allowing a seated user to lean rearwardly to a relaxed position. Typically, these chairs include an assist of some kind to support the user in the rearwardly tilted position and to aid the user in tilting forward when the user desires to move from the rearwardly tilted position to the forwardly upright position.

There are two major types of assists commonly used on office chairs and the like. The first type is a "materials based" assist which is most usually a spring grounded to the chair frame at one end and directly connected to the chair back at the other end, such as is illustrated in U.S. Pat. No. 530,880 to Briggs entitled "Chair". Alternatively, a chair shell is used made of resilient material which offers some flexibility between the chair seat and back. These assists tend to be of low cost and relatively simple in operation. However, these assists do not provide positive support for the user when the user initially begins to lean rearwardly, since these assists usually provide zero torque when the chair back is in the upright rest position. They also require high spring rates in order to produce the necessary support at the rearwardmost tilted position of the chair back. Still further, "materials based" assists usually do not have positive upright and reclined positions.

Recently, a second type of chair back assist has become popular, that being a "control based" assist such as is illustrated in U.S. Pat. No. 4,720,142 to Holdredge et al. entitled "Variable Back Stop". This type includes a discrete control apparatus attachable to the chair for controlling chair back movement, and potentially offers advantages of a preload for providing initial support as a user leans rearwardly, a positive rearward end stop, an apparent pivot axis located near a seated user's hips, and potentially greater control over design torque profiles as the chair back is tilted rearwardly. Also, the "control based" assists are usually discrete energy packages attachable to the chair in a manner offering assembly advantages. However, improvement on "control based" assists is also desired. These assists tend to be mechanically complex and expensive to manufacture. Further, they are somewhat bulky and larger than desired such that they limit chair designs. Also, they are typically not integral with the chair frame, seat, and back.

Thus, improvements in control of the chair back movement are desired. In particular, improvements are desired which would provide the functionality of the "control based" assists, but which do so in a less complex way that integrates the functional features into the structure of the chair. Further, the improvement should desirably be compatible with existing chair designs, components, and assembly practices.

SUMMARY OF THE INVENTION

In accordance with the present invention a chair control is provided which includes a unique flexible truss. The truss includes first and second spring means for absorbing energy that are resiliently flexible about an apparent axis of rotation and spaced different distances therefrom. The first and second spring means are operatively interconnected so as to permit relative longitudinal movement therebetween as the spring means are flexed. A unique cumulative torque versus displacement profile is derived.

In one form, the flexible truss includes a pair of nested springs that are spaced from each other by spacers to permit longitudinal movement therebetween. In another form, a chair includes a chair back and seat with a flexible truss interconnecting same to control the rearward tilting movement as the chair back is tilted rearwardly, the truss including stop means to limit the relative longitudinal movement between the first and second spring means so as to control the upright position of the chair back and also pretension the springs so that the chair back only begins to tilt upon overcoming the pretension. In still another form, the chair includes a corrugated member that mates with the flexible truss and forms a support surface for a seated user. In still another form, a chair includes a flexible shell having a resiliently flexible intermediate portion and a support surface integrally formed thereon, and a spring operably connected to the shell to form a tandem spring arrangement, the spring sliding longitudinally with respect to the shell as the shell and spring are flexed.

The invention offers several advantages over prior known art. The upright and reclined positions, as well as the preload for controlling the force necessary to initially tilt rearwardly on a chair can be preset to a desired setting Alternatively, each of these can be made adjustable such as by including adjustable end stops or a flexible truss that can be anchored to ground at different angles of pitch. Advantageously, a variety of desired torque versus displacement profiles can be achieved including a torque/displacement profile that is relatively flat in the range of use so that a desired level of support is given throughout the range of use. The arrangement provides a positive range of travel which is not load dependent, but which is controlled with a relatively non-complex stop. Further, the overall design can be made with relatively few parts and is integral with the chair structure. Still further, the arrangement has a slim and stylistic visual appearance. Thus, the invention lends itself to construction wherein the flexible truss can be integrally attached to different articles of furniture. At the same time, at least one modification is modular, and can be preassembled for later attachment to different articles of furniture.

These and other features, objects, and advantages of the present invention will become apparent upon reading the following description thereof together with reference to the accompanying drawings.

DETAILED DESCRIPTION OF THE DRAWINGS

FIG. 1 a perspective of a chair utilizing a flexible truss embodying the present invention;

DETAILED DESCRIPTION OF THE PREFERRED EMBODIMENTS

Figure 1:
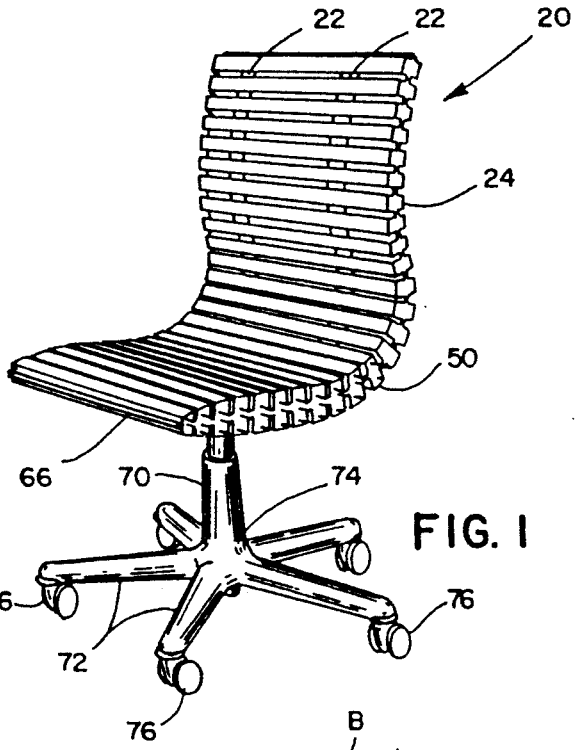

A chair 20 utilizing a flexible truss 22 embodying the present invention is shown in FIG. 1. Flexible truss 22 is particularly adapted for use on furniture where it is desirable to provide a relatively flat load versus displacement curve or profile for a movable member, and concurrently limit the displacement of same to a desired stroke, such as on a chair 20 having a tiltable chair back 24. Further, flexible truss 22 can be pretensioned to provide an initial resistance to movement so that the movable member only begins to tilt upon overcoming the pretension. This is useful where an initial degree of support is desired before allowing the movement.

Figure 2:
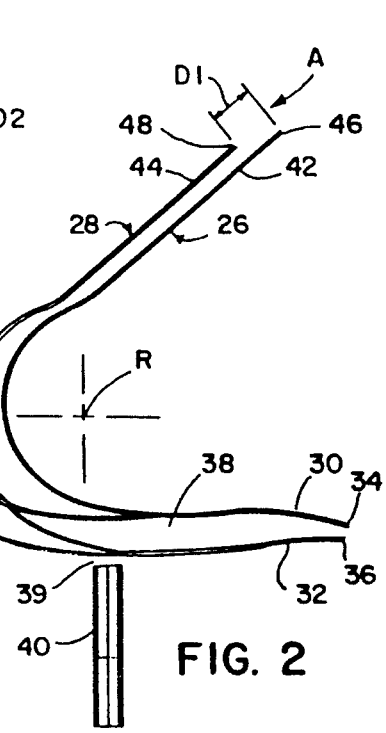
FIG. 2 is a schematic showing the position of first and second springs utilized in the flexible truss, the springs shown in various tilted positions.

The principle of operation of flexible truss 22 is generally illustrated in FIG. 2. Flexible truss 22 includes two shaped, elongated springs 26 and 28 placed tandemly adjacent each other but in spaced relation. Springs 26, 28 are bendable about a changing axis of rotation "R". The location of axis "R" changes as flexible truss 22 is flexed. Springs 26 and 28 can be substantially any length or free-form shape, but in the illustration are leaf-springs formed into a C-shape. Spring 26 is positioned inside of and spaced inwardly from spring 28. In the forwardmost position A, springs 26 and 28 are in a free, non-stressed condition. Lower end portions 30 and 32 of springs 26 and 28, respectively, extend generally horizontally parallel and include lower terminal ends 34 and 36, respectively, that are located vertically above each other. At some location near lower terminal ends 34, 36, such as at interconnection 38, springs 26 and 28 are securely interconnected. Also at a second interconnection 39, spring 28 is connected to "ground" by a support structure 40 capable of withstanding torque applied thereto. Springs 26 and 28 also include upper end portions 42 and 44, respectively, with terminal ends 46 and 48, respectively. Upper end portions are slideably interconnected by a spacer (not shown) or the like in one or more locations between upper ends 46, 48 and fixed interconnection 38.

As can be readily seen in FIG. 2, as springs 26 and 28 are bent rearwardly, upper end portions 42 and 44 slide longitudinally with respect to each other. This changing differential distance is designated at upper ends 46, 48 as distance D1 in position A, distance D2 in position B, and distance D3 in position C. Notably, by limiting the ability of one spring to longitudinally slide with respect to the other, the end points of the path of movement of end portion 42 (and 44) can be controlled. Further, a particular segment of a combined or cumulative load versus displacement curve of the two springs can be preselected. Optimally, the curve segment includes an initial selected pretension force that must be overcome before flexible truss 20 begins to flex, and a maximum selected end point at which flex truss 20 will not bend beyond. Advantageously, the torque versus displacement curve can be relatively flat as shown in attached FIG. 11 and discussed below.

Figure 11:
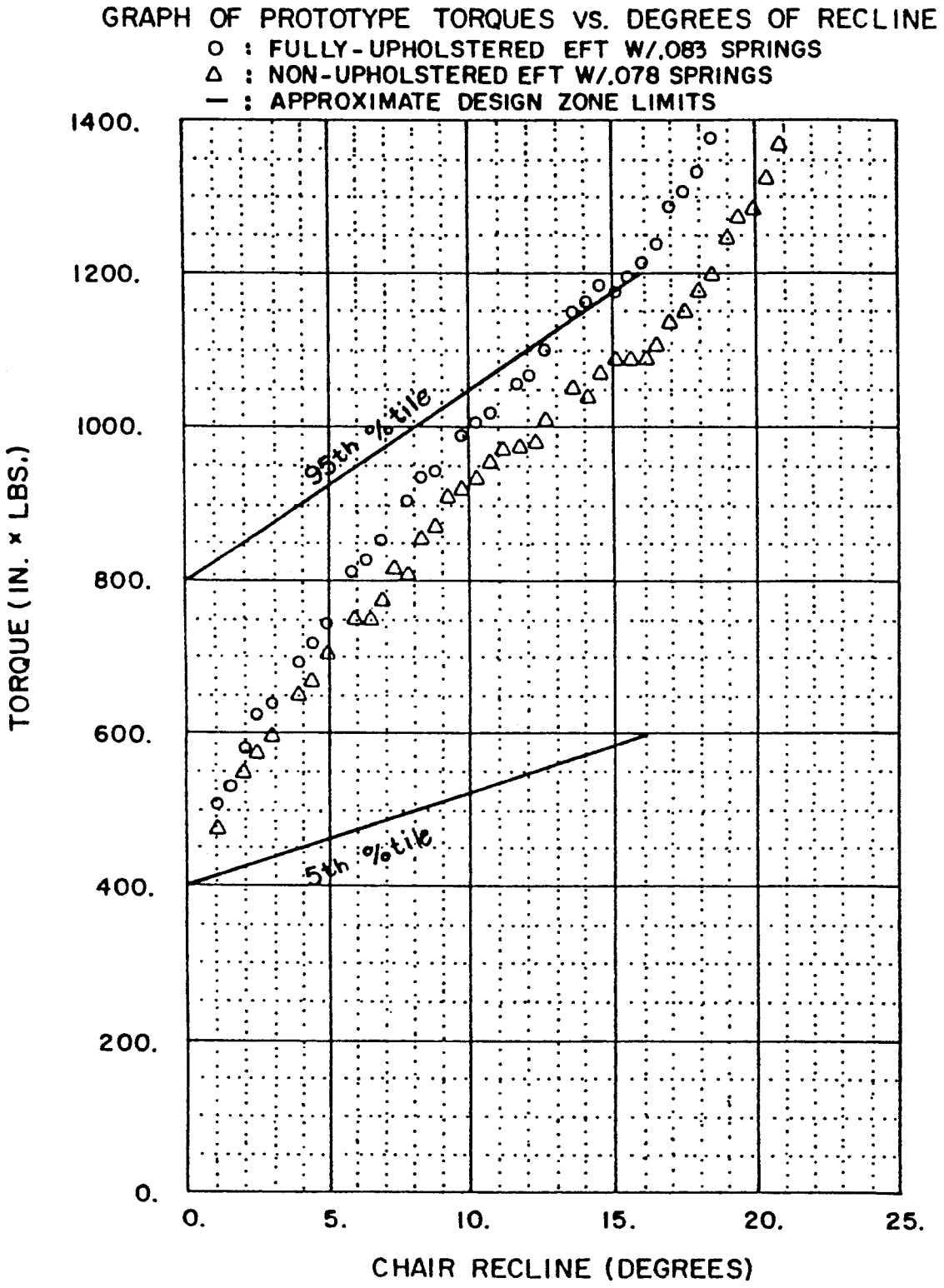
FIG. 11 is a graphic representation of a typical load versus displacement profile of a flexible truss.

Flexible truss 22 is particularly adapted for use in a chair having a tiltable chair back, such as for controlling the path of movement of the chair back, the end points of the chair back movement, and the torque versus displacement profile over such movement. FIG. 11 is a graph of test data illustrating a particular torque versus displacement profile of two prototype chairs constructed similar to the chair 20 shown in FIG. 1. The lower horizontal axis is denominated as the degrees of chair back recline, and the vertical axis is denominated in inch pounds of torque. Shown on the chart are upper and lower lines specifying approximate design comfort zone limits for a typical population of people (i.e. a desired load versus displacement profile) including a lower limit line labeled as a "fifth-percentile" and an upper limit line labeled as a "ninety-fifth-percentile". One prototype chair was fully upholstered and included leaf springs of a thickness of about 0.083 inches, and when flexed generated data designated by circles on the graph. The second prototype was not upholstered and included leaf springs of a thickness of about 0.078 inches, and when flexed generated data designated by triangles on the graph. At zero degrees of tilt, the chair backs were in the "B" position as shown in FIG. 2. As can be seen, in this position, both chairs required about 400 inch pounds of torque before the chair back could be moved from this position. Thus, a seated user would receive about 400 inch pounds of support before the user would begin to tilt rearwardly.

Additionally, the torque versus displacement curves are both relatively flat and linear as the chair back is displaced from a zero degree recline at 400 inch pounds of torque to a 15 degree recline at about 1050 to 1200 inch pounds of torque. This relatively flat curve allows both chairs to stay substantially within the desired design zone limits. Notably, the curves are not entirely linear, and are affected by a number of factors including the location at which the springs are rigidly interconnected, the location and number of slideable attachments, the frictional resistance and other complex forces acting at those locations, the degree to which the springs are deformed from the shape to which they would normally bend if not interconnected, and similar factors.

The points of zero torque (i.e. the "A" or unstressed positions) are not shown on the graph, but would be located off of the graph to the left in a negative direction on the horizontal axis. Significantly, the spring arrangements which have a lower spring constant must be bent farther to obtain the desired 400 inch pounds of prestress torque at zero degrees (the "B" position) than the spring arrangements which tend to have a higher spring constant. However, the spring arrangements with the lower spring constant will tend to have a flatter torque versus displacement profile, thus allowing them to stay within the desired design zone limits more easily.

Figure 3:
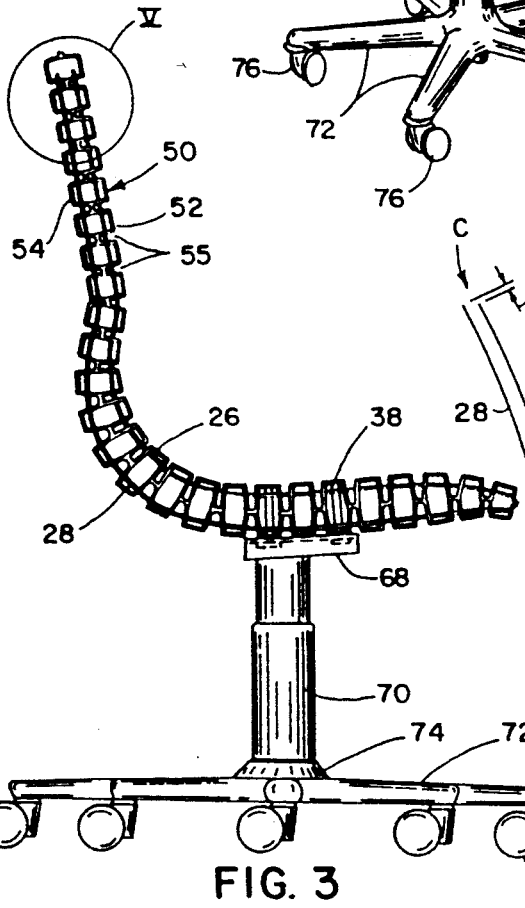
FIG. 3 is a side view of FIG. 1.

Chair 20 (FIG. 3) includes two flexible trusses 22 spaced laterally apart, both of which include a pair of springs 26 and 28. A corrugated member or shell 50 cooperatingly encloses springs 26 and 28 to form a flexible support thereon for a seated user. Corrugated member 50 is made from front and rear undulated sheets 52 and 54. Each sheet 52, 54 has multiple undulations 55 with somewhat sharp folds so that it forms a curvilinear outer surface 56, an abutting inner surface 58 and interconnecting webs or walls 60. Outer surface 56 of front sheet 52 forms a support for a user both on chair back 24 and chair bottom or seat 66. Multiple apertures or slots 62 are cut into webs 60 to form pockets for receiving springs 26, 28. Springs 26, 28 are then threaded into slots 62, and springs 26, 28 are placed adjacent each other so that inner surfaces 58 of sheets 52, 54 can be the interconnected by rivets 63, bolts, spot welds, adhesive or the like. Due to undulations 55, sheets 52 and 54 are flexible and conform to the shape of springs 26 and 28 as they are flexed. Sheets 52, 54 also provide lateral stiffness to laterally hold springs 26, 28 in position from side to side. Sheets 52, 54 can also limit springs 26, 28 to a given maximum distance apart if this may be desired. Sheets 52, 54 generally cover springs 26, 28 and prevent undesired contact therewith during flexing, while also providing a unique feel and appearance. Due to the shape of springs 26, 28, upper end portion 42, 44 join with corrugated member 50 to form the chair back 24, and lower end portions 30, 32 join with corrugated member 50 to form chair bottom 66.

Figure 6:
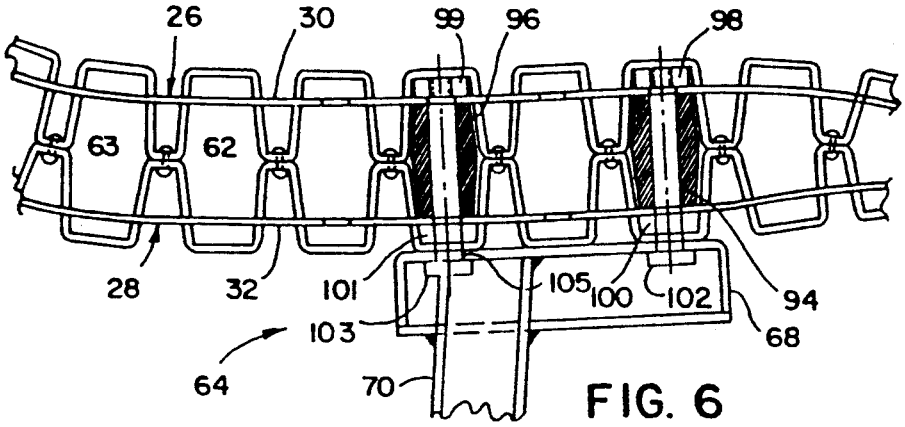
FIG. 6 is an enlarged side view of the chair seat in FIG. 3.

A mounting structure 6 (FIG. 6) rigidly fastens to lower end portions 30, 32 and chair seat 66. Mounting structure 64 includes a boxlike connector 68 with a downwardly oriented chair pedestal post 70 attached thereto. At the bottom of pedestal post 70 is a pedestal base 74 with radial legs 72 extending outwardly from pedestal base 74 to casters 76. Radial legs 72 extend outwardly sufficiently to stabilize chair 20, with casters 76 making chair 20 readily mobile.

Figure 5:
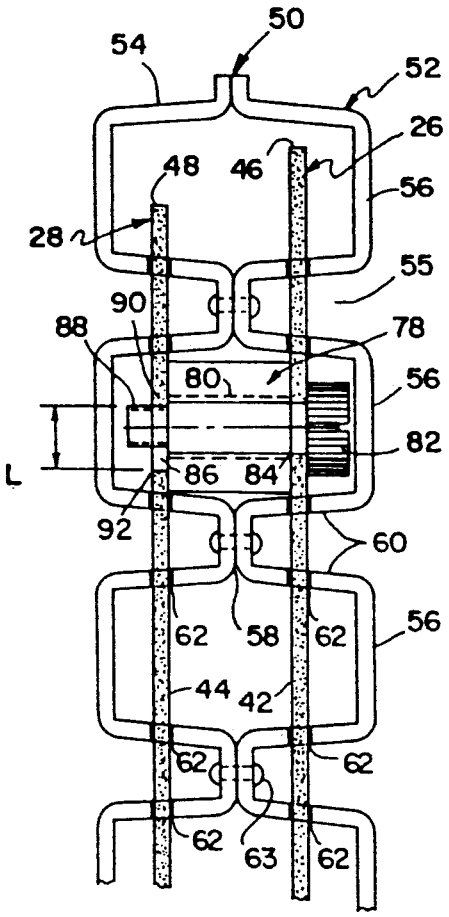
FIG. 5 is an enlarged side view of circle V in FIG. 3.
Figure 4:
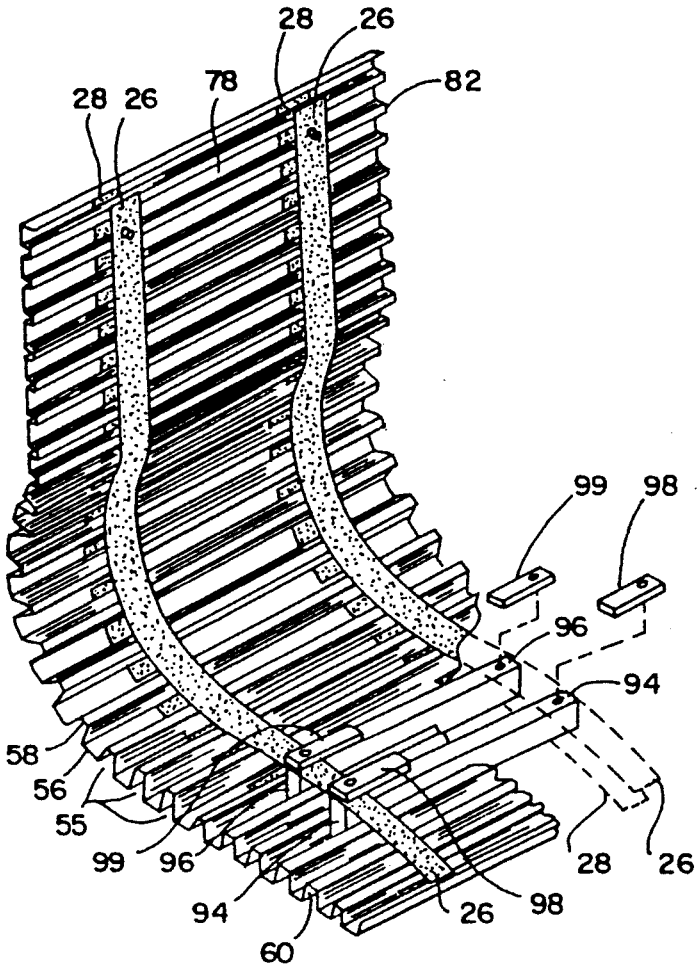
FIG. 4 is an enlarged perspective view of the chair seat and back in FIG. 1 but with the upper corrugated member removed.

In FIG. 4, chair 20 is illustrated with front sheet 52 removed for clarity. A spacer bar 78 (FIG. 4–5) is positioned in one of undulations 55 between upper end portions 42, 44 near terminal ends 46, 48. Spacer bar 78 is substantially an elongate rectangular bar and includes threaded apertures 80 for receiving studs 82. Spring 26 includes a mating aperture 84, and spring 28 includes a mating slot 86 having a length "L". Stud 82 is secured through spring aperture 84 and spacer bar apertures 80, with the protruding end 88 of stud 82 extending into slot 8 of spring 28. As springs 26, 28 are flexed, protruding end 88 of stud 82 slides within slot 86 and engages the ends 90 and 92 of slot 86. Stud 82 thereby acts as a stop with slot 86 and limits the travel of flexible truss as it moves between the forwardmost upright position "B" and rearwardmost tilted position "C". Notably, slot 86 and aperture 84 could be reversed in position in springs 26, 28. Also, by varying the length "L" of slot 86, the upright and tilted positions "B" and "C" are varied.

Front and rear spacer bars 94 and 96 (FIG. 6) space springs 26 and 28 apart at lower end portions 30 and 32 and provide for the secure and rigid interconnection of springs 26 and 28. Top and bottom nut bars 98, 99, 100, and 101 are placed adjacent spacer bars 94, 96 on opposite sides of springs 26, 28 and within undulations in sheets 52, 54. Mounting bolts 102 and 103 are slideably placed through holes 105 in mounting connector 68 and respectively slideably through sheet 54, bottom nut 100, spring 28, spacer bar 94 (96), spring 26, and threadingly into nuts 98 and 99 respectively. Multiple bolts 102 and 103 are inserted as required to fixedly secure flexible truss 22 to mounting structure 64. Spacer bars 94 and 96 provide support to corrugated member 50 so that it is not crushed as bolts 102,103 are tightened.

In assembly, springs 26 and 28 are interconnected by spacer bars 94 and 96 to mounting structure 64 by use of bolts 102 and 103 and nuts 98 and 99 with corrugated sheets of 52 and 54 in place thereon. Upper ends portions 42 and 44 are then moved from position "A" to position "B" so as to pretension springs 26 and 28 against each other. While in the "B" position, stud or bolt 82 is installed into aperture 80 of spacer bar 78 and into slot 86 so as to hold springs 26 and 28 in position "B". A covering material or upholstery (not shown) is then added as desired.

Though one assembly sequence is noted, a number of such sequences are possible. For example, it is contemplated that flexible truss 22 can be preassembled for use as an energy absorbing or load bearing device so that it can be assembled as a unit onto multiple different devices such as chairs, benches, and the like.

In use, a seated user is supported in the upright position on chair 20 until the user leans rearwardly on chair back 24 with enough force to overcome the pretension in flexible truss 22. As the user leans rearwardly, chair back 24 is increasingly supported by a counteracting torque, but at a slowly increasing torque rate that keeps the counteracting torque within acceptable torque limits so that the user is comfortably supported. The user continues to tilt rearwardly until stud 82 bottoms out in slot 86, thereby limiting the ability to continue to tilt rearwardly. This is accomplished by limiting the longitudinal movement of springs 26 and 28 relative to each other as they are flexed about axis "R".

Figure 7:
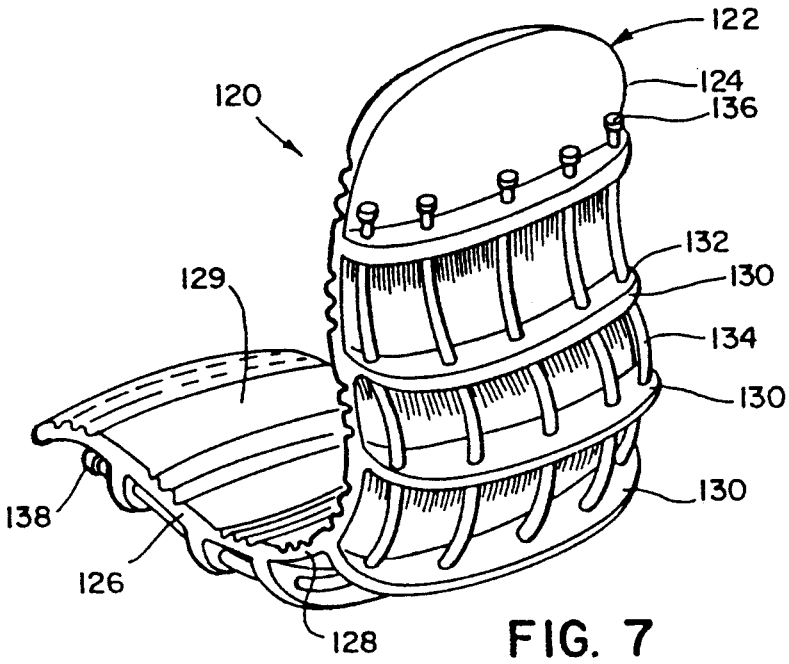
FIG. 7 is a perspective view of a second embodiment of a chair utilizing a flexible truss embodying the present invention.

It is also contemplated that a flexible truss 120 could be constructed wherein one of the two flexible members is a chair shell, such as chair shell 122 (FIG. 7). Chair shell 122 includes an upper portion 124 forming a chair back, a lower portion 126 forming a chair seat, and an intermediate portion 128, intermediate portion 128 being resiliently flexible so as to operably interconnect the chair seat and back. Chair shell 122 includes an integrally formed front surface 129 acting as a support for users. Multiple ribs 130 extend horizontally across and rearwardly from upper portion 124 and downwardly from lower portion 126. Each rib 130 contains multiple vertically aligned apertures 132. Spring-like members 134 are slideably retained in apertures 132 so as to permit longitudinal movement therein during flexing, and captured therein by end retainers 136 and 138. The spring-like members 134 shown have a circular section, although it is contemplated that leaf springs or other shapes could also be used. Retainers 136 and 138 would be installed on spring-like members 134 as desired, retainers 136, 138 acting as stops to limit the movement of spring-like members 134 in response to rearward tilting of chair back 124. Notably, retainers 136 could be installed anywhere along the length of spring-like members 134, and could be made adjustable so as to allow on-site adjustment of the upright and tilted positions of chair back 124. Also, adjustability of retainers 136 could allow adjustment of the pretension between intermediate portion 128 and spring-like members 134.

In operation, a user sits on chair 120 and leans rearwardly with sufficient force to overcome the pretension force on chair back 124. As chair back 124 begins to move rearwardly, spring-like members 134 flex and slide longitudinally within apertures 132 until one of end retainers 136 and 138 engage ribs 130, stopping the rearward movement. In the rearwardly tilted position, both the shell 122 and spring-like members 134 combine to comfortably support the seated user.

Figure 9:
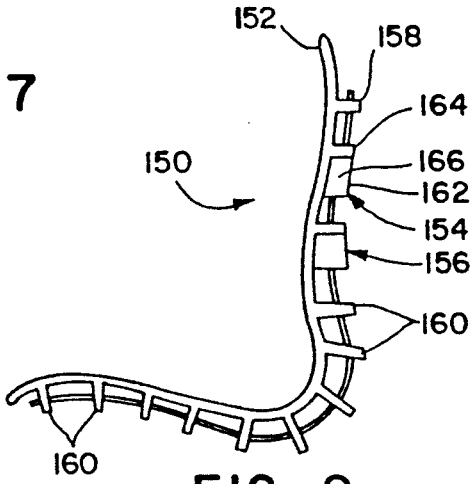
FIG. 9 is a side sectional view of FIG. 8.
Figure 8:
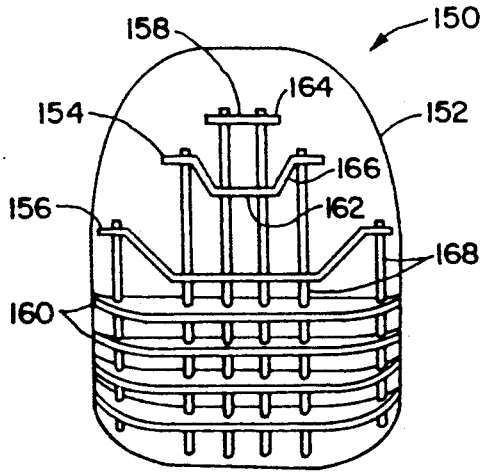
FIG. 8 is a rear view of a third embodiment of a chair utilizing a flexible truss embodying the present invention.

A chair 150 of a third embodiment (FIGS. 8 and 9) is related to the second embodiment chair 120 (FIG. 7), but illustrates that the ribs need not be continuously horizontal or that the rods need not be uniformly spaced or supported or of similar length. Chair 150 includes a shell 152 similar to shell 122 but with irregular ribs 154 and 156 and foreshortened rib 158 along with multiple horizontal ribs 160. Irregular ribs 154 and 156 each include a main portion 162 and offset end portions 164 connected by angled portions 166. Apertures are placed therein as desired to receive rods or spring-like members 168. Members 168 are of different lengths and different spacings as desired to maximize support and comfort. Spring-like members 168 are also bent into different free-form configurations as will be noted by comparing the outermost rods with the innermost rods along the bottom of chair 150. Chair 150 also utilizes additional ribs along the lower lumbar supporting area of the chair, thus providing additional support along the length of rods 168 and shell 152 in that area. It is contemplated that stops (not shown) could be placed on the outermost spring-like members 168 to limit the movement of shell 152 in the lumbar area while still allowing rearward tilting of the chair back.

Figure 10:
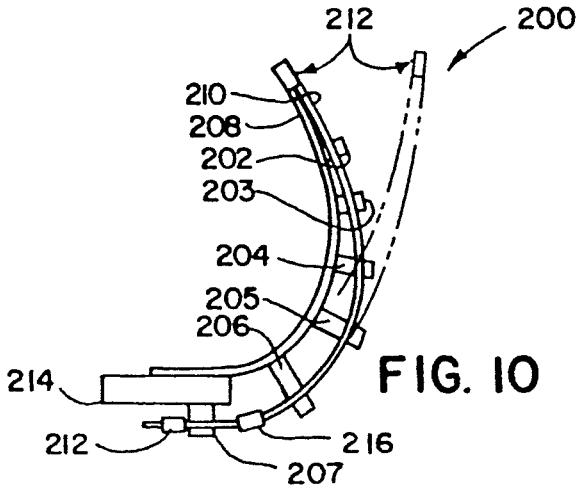
FIG. 10 is a side sectional view of a fourth embodiment of a flexible truss embodying the present invention.

A flexible truss 200 (FIG. 10) illustrates yet another embodiment, this embodiment being in the form of a separate, self contained energy package. In flexible truss 200, non-uniform spacers 202–207 are used to space inner leaf spring 208 from outer leaf spring 210. Springs 208 and 210 are preformed to a C-shape in the unstressed state, and are securely rigidly interconnected at their uppermost end at location 212. At the lower end, spring 208 is rigidly connected to mounting structure 214. Slotted stops 216 and 218 with thumb screws (not shown) attach to spring 210 on either side of standoff 207 and limit the longitudinal motion of spring 210 on spring 208 as they are flexed by engaging standoff 207 as springs 208 and 210 are flexed. The flexed or rearwardly titled position of flexible truss 200 is shown in phantom.

Flexible truss 200 could be utilized in any article of furniture wherein a unique torque versus displacement profile is desired, or where it is desired to limit displacement of an item to a particular stroke. For example, a chair back (not shown) could be formed on inner spring 208. As the chair back was tilted rearwardly, stops 216 and 218 would determine the upright and tilted positions of the chair back by engaging bottom standoff 207. Rotatably, the position of stops 208 and 210 could be adjustable, permitting the upright and tilted positions of the chair back to be custom-set on-site.

The above embodiments are for illustration only, and the invention is not intended to be limited by just the examples shown. For example, springs 26 and 28 could be of several different designs, and need not be limited to a C-shape or a leaf spring design. Further, the fixed interconnection 38 need not be located on the lower ends of springs 26 and 28, but can be located anywhere therealong. Further, multiple spacers can be used, or springs 26 and 28 can be directly slideably interconnected or can be interconnected with pivotable links. Still further, the arrangement need not be limited to two springs, but can include multiple pairs of springs spaced side-by-side, multiple springs placed in a laminate arrangement, or irregularly spaced springs. Further, the springs need not be all of the same length or shape. Still further, the springs could be assembled as a separate unit before installation on various articles of furniture, simplifying assembly.

It will become apparent to those skilled in the art that various modifications to the preferred embodiments of the invention can be made without departing from the spirit or scope thereof as defined by the appended claims.

The embodiments of the invention in which an exclusive property or privilege is claimed are defined as follows:

1. A chair, comprising:

a chair seat;

a chair back operably interconnected to said chair seat for relative rearward movement; and a flexible truss operably connected to and interconnecting said chair back and seat for supporting said chair back during said rearward movement, comprising:

a first elongate spring means for absorbing energy having a length and shape that extends from said chair seat to said chair back, said first elongate spring means being attached to said chair seat and chair back and controlling the rearward movement of said chair back, said first spring means being resiliently flexible and defining a first torque versus displacement profile;

a second elongate spring means for absorbing energy having a length and shape corresponding to said first elongate spring means so that said second elongate spring means also extends from said chair seat to said chair back, said second spring means being resiliently flexible and defining a second torque versus displacement profile, said second spring means being spaced a distance from said first spring means such that at least a part of said first and second spring means slidingly move longitudinally with respect to each other during flexing; and means for operably interconnecting said first and second spring means along said lengths including locations proximate the ends of said spring means in an interactive arrangement so that said first and second profiles combine to define a desired torque versus displacement profile, said first and second spring means being fixed to each other at one location, but being relatively movable at other locations so as to define the desired torque versus displacement profile as said chair back is moved relative to said chair seat.

2. An apparatus as set forth in claim 1 including at least one spacer that spaces said first and second spring means apart, but which permits relative longitudinal movement between said spring means as said spring means are flexed.

3. An apparatus as set forth in claim 1 wherein at least one of said elongate spring means includes leaf springs.

4. An apparatus as set forth in claim 3 wherein said first and second spring means are arranged in a tandem arrangement in pairs.

5. An apparatus as set forth in claim 1 including a sheet folded to form a corrugated member that is operably connected to said flexible truss, said corrugated member having a plurality of first walls oriented generally normally to said flexible truss, and a plurality of second walls connected to said first walls and defining a support surface thereon adapted to support a seated person, said support surface including portions defining said chair seat and other portions defining said chair back.

6. An apparatus as set forth in claim 5 wherein said first walls include apertures for receiving at least one of said elongate spring means, said corrugated member being adapted to flex with said at least one elongate spring means.

7. An apparatus as set forth in claim 1 including stop means for limiting the longitudinal movement between said first and second spring means as said spring means are flexed.

8. An apparatus as set forth in claim 7 including spacers located at said locations for spacing said first and second spring means a predetermined distance apart along the lengths of said spring means.

9. An apparatus as set forth in claim 7 wherein said stop means pretensions said first and second spring means so that said flexible truss only begins to bend upon overcoming the pretension in said flexible truss.

10. An apparatus as set forth in claim 1 wherein said flexible truss acts to control the movement of said chair back as said chair back moves between upright and tilted positions.

11. An apparatus as set forth in claim 2 including stop means operably attached to said first and second spring means for limiting the longitudinal movement between said first and second spring means as said spring means are flexed, said stop means controlling the position of said chair back when in one of said upright and tilted positions.

12. An apparatus as set forth in claim 3 wherein said stop means is adjustable to vary the location of said upright and tilted positions.

13. A modular flexible truss for use on a chair including a chair seat and a chair back, comprising:

first and second elongate springs each having a comparable length and shape, said springs being arranged in a nested arrangement so that at least a part of said springs slide relative to each other as they are flexed, said first elongate spring including an end connected to said chair seat and another end connected to said chair back so that said first spring controls the rearward movement of said chair back; and means for operably interconnecting said first and second springs along said lengths in an interactive arrangement wherein portions of said first and second springs are displaced with respect to each other and exhibit a desired torque versus displacement profile during flexing, said means for operably interconnecting including spacers that space said first and second springs apart and permit relative movement between portions of said first and second springs as said springs are flexed, so that a unique torque versus displacement profile different from the individual characteristics of said springs is obtained as said flexible truss is flexed.

14. An apparatus as set forth in claim 13 wherein said elongate springs include leaf springs.

15. An apparatus as set forth in claim 13 including stop means for limiting the longitudinal movement between said first and second spring as said springs are flexed.

16. An apparatus as set forth in claim 15 wherein said stop means includes a first stop to stop said first and second springs in a first position, said flexible truss being pretensioned when in said first position so that said flexible truss only can be flexed upon overcoming the pretension in said flexible truss.

17. A flexible truss for use on furniture, comprising:

first and second elongate springs having a length and shape, said springs being arranged in a nested arrangement so that at least a part of said springs slide relative to each other as they are flexed;

means for operably interconnecting said first and second springs along said lengths in an interactive arrangement wherein portions of said first and second springs are displaced with respect to each other and exhibit a desired torque versus displacement profile during flexing, said means for operably interconnecting including spacers that space said first and second springs apart and permit relative movement between portions of said first and second springs as said springs are flexed, so that a unique torque versus displacement profile different from the individual characteristics of said springs is obtained as said flexible truss is flexed; and stop means for limiting the longitudinal movement between said first and second springs as said springs are flexed, said stop means including a first stop adapted to restrain said first and second springs in a first position, said flexible truss being pretensioned when in said first position so that said flexible truss only can be flexed upon overcoming the pretension in said flexible truss, said stop means including a slot in one of said springs and a peg in the other of said springs, said peg slideably positioned in said slot of said one spring and engaging the ends of said slot to limit the longitudinal movement between said springs.

18. An apparatus as set forth in claim 17 wherein said elongate springs include leaf springs.

19. A chair comprising:

a chair seat;

a chair back located at an angle to said chair seat and movable between a tilted position and an upright position with respect to said chair seat;

a flexible truss operably interconnecting said chair seat and chair back, said flexible truss controlling the path of movement of said chair back and the force required for said movement, comprising: first and second elongate springs having a length and shape, said springs being arranged in tandem in a nested arrangement so that portions of said springs move relative to each other as they are flexed; means for interconnecting said first and second springs along said lengths in an interactive arrangement, said means for interconnecting including at least one spacer that spaces said first and second springs apart so that a unique torque versus displacement profile can be obtained as said first and second springs are flexed; and stop means interconnecting said first and second springs for limiting the longitudinal movement between said first and second springs as said springs are flexed to thereby control the location of said chair back when in said upright position, said stop means pretensioning said first and second springs when in said upright position so that said chair back only begins to tilt rearwardly upon overcoming the pretension in said springs.

20. A chair as defined in claim 19 wherein said at least one spacer includes a plurality of spacers.

21. A chair comprising:

a shell including a back and seat and an intermediate portion connecting said back and seat, said shell being resiliently flexible about said intermediate portions so as to permit said back to tilt rearwardly relative to said seat;

at least one elongate spring having a length operably connected to said shell at multiple locations along said length in an interactive arrangement wherein said spring and said intermediate portion are in tension against each other during flexing, said shell being configured to slideably engage said at least one elongate spring at several locations, said spring being slideably attached to said shell at said several locations so that said shell and spring combine to form a tandem spring arrangement, said spring including a portion that moves longitudinally with respect to said shell as the spring and shell are simultaneously flexed; and stop means for limiting the longitudinal movement of said spring relative to said shell, said stop means engaging said spring and abuttingly engaging said shell at one of said locations to hold said spring and shell in pretension so that said back only begins to move rearwardly upon overcoming said pretension.

22. A flexible truss for use on a chair including a seat and a back, the back being movable in a rearward direction and a forward direction, comprising:

an elongated spring associated with the back for biasing the back in the forward direction to an upright position relative to the seat, said elongated spring having first and second ends;

an elongated member including a third end fixed relative to said spring first end, and including a fourth end;

spacers for spacing at least a portion of said elongated member a distance from said elongated spring so that said fourth end moves longitudinally relative to said second end of said elongated spring when said elongated spring is flexed; and a stop operably connecting said fourth end of said elongated member to said second end of said elongated spring for limiting the relative movement of said second end with respect to said fourth end in at least one direction when said elongated spring is flexed and thus limiting the overall movement of said back as said back is moved in one of said forward direction and said rearward direction.

23. A flexible truss as defined in claim 22 wherein said elongated member includes a second elongated spring.

24. A flexible truss as defined in claim 22 wherein said elongated spring includes a one-piece shell.

25. A flexible truss as defined in claim 22 wherein said elongated member limits the movement of the back in the forward direction.

26. A flexible truss as defined in claim 22 including a flexible sheet forming said seat and back.

27. A flexible truss as defined in claim 26 wherein said sheet includes multiple folds to thus form a corrugated member.

28. A flexible truss as defined in claim 22 wherein said elongated member limits the movement of the back in the rearward direction.

29. A flexible truss as defined in claim 28 wherein said elongated member limits the movement of the back in the forward direction.

* * * * *

UNITED STATES PATENT AND TRADEMARK OFFICE

CERTIFICATE OF CORRECTION

PATENT NO. : 5,320,410

DATED : June 14, 1994

INVENTOR(S) : Frederick S. Faiks et al.

It is certified that error appears in the above-indentified patent and that said Letters Patent is hereby corrected as shown below:

Column 2, line 2;
After "setting" insert --.--.

Column 5, line 25;
"structure 6" should be --structure 64--.

Column 5, line 44;
"8 of spring" should be --86 of spring--.

Column 9, line 22, claim 11;
"claim 2" should be --claim 10--.

Column 9, line 29; claim 12;
"claim 3" should be --claim 11--.

Column 9, line 60, claim 15;
"second spring" should be --second springs--.

Column 11, line 1, claim 21;
"portions" should be --portion--.

Signed and Sealed this

Seventeenth Day of January, 1995

*Attest:*

Bruce Lehman

BRUCE LEHMAN

*Attesting Officer*

*Commissioner of Patents and Trademarks*